US007883396B2

(12) United States Patent
Potterfield et al.

(10) Patent No.: US 7,883,396 B2
(45) Date of Patent: Feb. 8, 2011

(54) VIBRATORY TUMBLERS FOR PROCESSING WORKPIECES AND METHODS FOR PACKAGING AND CONSTRUCTING SUCH TUMBLERS

(75) Inventors: Russell A. Potterfield, Columbia, MO (US); Tim Morrow, Jefferson City, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 634 days.

(21) Appl. No.: 11/507,683

(22) Filed: Aug. 21, 2006

(65) Prior Publication Data

US 2008/0041700 A1 Feb. 21, 2008

(51) Int. Cl.
*B24B 31/00* (2006.01)

(52) U.S. Cl. ..... 451/326; 451/327; 451/328

(58) Field of Classification Search ..... 451/32, 451/35, 326, 327, 328, 329
See application file for complete search history.

(56) References Cited

U.S. PATENT DOCUMENTS

| | | | | |
|---|---|---|---|---|
| 2,476,078 | A | 7/1949 | Banks | |
| 2,813,376 | A | 11/1957 | Middlemark | |
| 2,924,914 | A | 2/1960 | Garwood | |
| D215,311 | S | 9/1969 | Born | |
| 3,513,604 | A | 5/1970 | Matsunaga et al. | |
| 3,587,193 | A | 6/1971 | Lewis | |
| 3,680,266 | A | 8/1972 | Shiplov | |
| 3,769,758 | A | 11/1973 | McDonald | |
| 3,813,816 | A | 6/1974 | Funk | |
| D233,853 | S | 12/1974 | Ferrara | |
| 3,885,357 | A | 5/1975 | Hoyt | |
| 3,893,266 | A | 7/1975 | Anderson et al. | |
| D237,106 | S | 10/1975 | Baljet et al. | |
| 4,021,971 | A | 5/1977 | McFadden | |
| 4,143,491 | A | 3/1979 | Blanc | |
| 4,177,608 | A | 12/1979 | Balz | |
| 4,206,573 | A | 6/1980 | Hayward | |
| D260,650 | S | 9/1981 | Alviti | |
| 4,301,625 | A | 11/1981 | Rampe | |
| 4,751,963 | A | 6/1988 | Bui et al. | |
| 4,850,151 | A | 7/1989 | Ditscherlein | |
| 5,117,850 | A | 6/1992 | Money | |
| 5,375,377 | A * | 12/1994 | Kenton | 451/22 |
| 5,486,135 | A | 1/1996 | Arpaio | |
| 5,653,625 | A | 8/1997 | Pierce et al. | |
| 5,662,516 | A | 9/1997 | You | |
| 5,779,527 | A | 7/1998 | Maebashi | |
| 6,110,020 | A | 8/2000 | Rolfi | |
| 6,814,654 | B2 | 11/2004 | Rolfi | |

* cited by examiner

*Primary Examiner*—Eileen P. Morgan
(74) *Attorney, Agent, or Firm*—Perkins Coie LLP

(57) ABSTRACT

Vibratory tumblers for processing workpieces and methods for manufacturing such vibratory tumblers are disclosed herein. In one embodiment, a vibratory tumbler includes a base, a support member movably coupled to the base, a bowl configured for removable attachment to the support member, and a motor attached to the support member for moving the bowl relative to the base. The bowl is sized and configured such that the support member and at least one-fourth of the base can be received within the bowl while the support member is coupled to the base.

35 Claims, 9 Drawing Sheets

VIBRATORY TUMBLERS FOR PROCESSING WORKPIECES AND METHODS FOR PACKAGING AND CONSTRUCTING SUCH TUMBLERS

TECHNICAL FIELD

The present invention is directed to vibratory tumblers for processing workpieces and methods for packaging and constructing such tumblers.

BACKGROUND

Vibratory tumblers are often used to clean and polish firearm casings for reloading. Typically, a batch of casings is placed in a vibratory tumbler with an abrasive or polishing media. The tumbler vibrates the casings so that the casings rub against each other and the abrasive or polishing media. The contact between different casings and between the casings and the media removes dirt, grease, lubricants, powder stains, and/or tarnish from the casings.

FIG. 1A is a front elevational view of a conventional vibratory tumbler 1 in accordance with the prior art. The vibratory tumbler 1 includes a base 10, a motor plate 30 movably attached to the base 10, a motor (not shown) rigidly attached to the motor plate 30, a bowl 50 removably attached to the motor plate 30, and a lid 90 removably attached to the bowl 50. The motor plate 30, the bowl 50, and the lid 90 are coupled together with a rod that extends through the bowl 50. Specifically, the rod has a first end attached to the motor plate and a second end attached to the lid. The motor is a vibratory motor that vibrates the motor plate 30, which in turn vibrates the bowl 50 and the casings within the bowl 50. Because the base 10 is attached to the motor plate 30 with a plurality of springs, the base 10 does not vibrate with the motor plate 30 and the bowl 50.

FIG. 1B is a schematic side cross-sectional view of the bowl 50 in FIG. 1A. The bowl 50 includes a base 52, a wall 70, and a protrusion 64 projecting from the base 52. The protrusion 64 includes a through hole 66 for receiving the rod that couples the motor plate 30 (FIG. 1A), the bowl 50, and the lid 90 (FIG. 1A) together. The protrusion 64 projects to nearly the top of the bowl 50 to prevent liquid media from spilling out of the bowl 50 via the hole 66.

The conventional vibratory tumbler 1 has several drawbacks. First, the tumbler 1 is a bulky device with a large height or profile. As a result, the tumbler 1 is expensive to ship because shipping rates are based in part on the volume of a package. Second, it is difficult to pour the used abrasive or polishing media from the bowl 50 into a container without spilling the media. The used abrasive or polishing media typically carries bullet lube, polish, powder residue, and dirt that can soil or damage clothing and other objects. This problem is particularly acute in applications in which the media includes a liquid. Third, the bowl 50 is typically made of a polymeric material that is not suitable for use with some abrasive media. As a result, conventional tumblers may not be used in some particularly abrasive deburring processes. Accordingly, there exists a need to improve conventional vibratory tumblers.

DETAILED DESCRIPTION

A. Overview

Figure 1A:
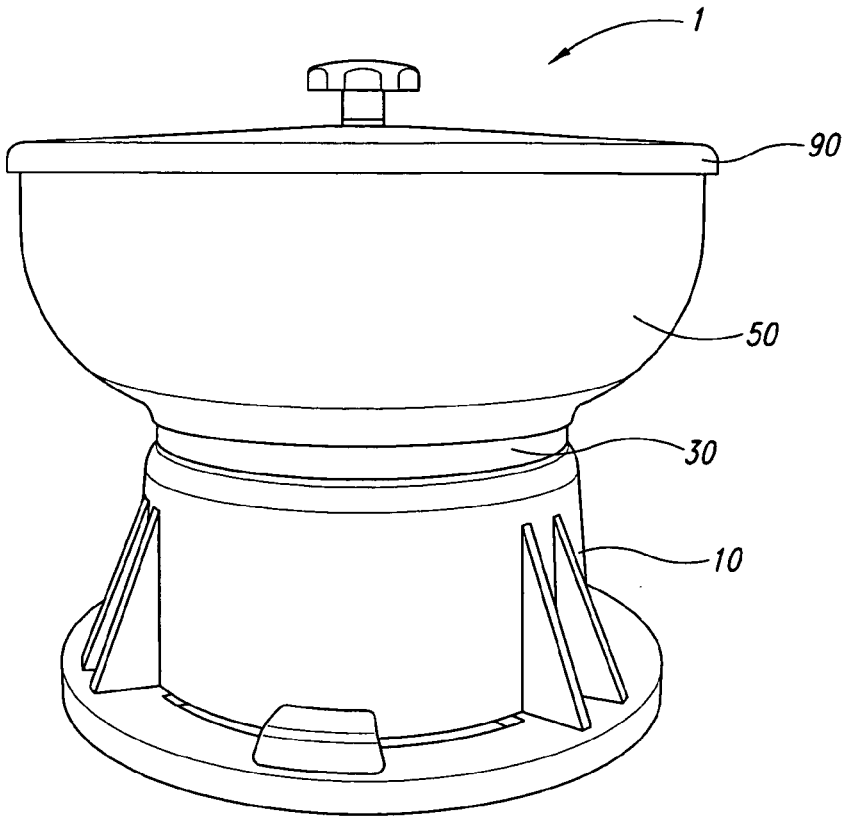
Fig. 1A (Prior Art)
FIG. 1A is a front elevational view of a conventional vibratory tumbler in accordance with the prior art.
Figure 1B:
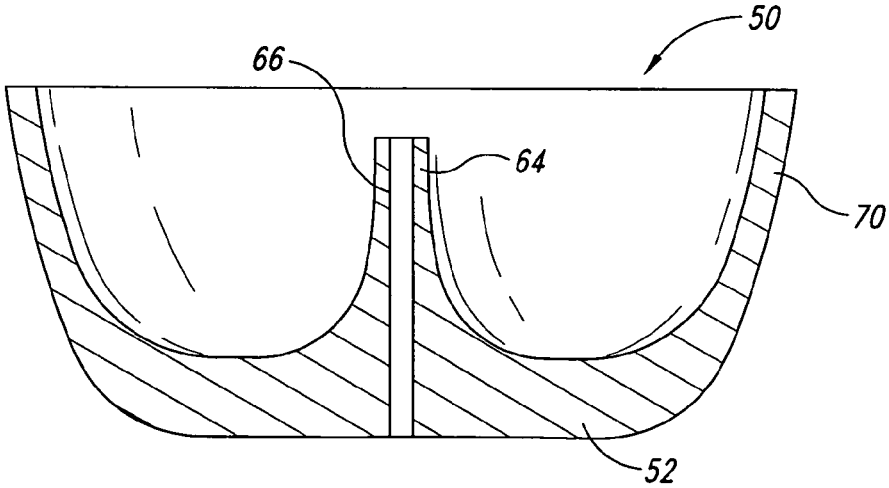
Fig. 1B (Prior Art)
FIG. 1B is a schematic side cross-sectional view of the bowl in FIG. 1A.

The following disclosure describes several embodiments of vibratory tumblers for processing workpieces and methods for manufacturing such vibratory tumblers. In one embodiment, a vibratory tumbler includes a base, a support member movably coupled to the base, a bowl configured for removable attachment to the support member, and a motor attached to the support member for moving the bowl relative to the base. The bowl is sized and configured such that the support member and at least one-fourth of the base can be received within the bowl while the support member is coupled to the base.

In another embodiment, a vibratory tumbler includes a base, a support member movably coupled to the base, a bowl removably attached to the support member, and a motor attached to the support member for moving the support member and the bowl relative to the base. The bowl includes a base portion and a wall portion projecting from the base portion in a first direction. The base portion includes a projection projecting generally in the first direction. The projection has a blind hole. The tumbler may further include a lid for covering the bowl and a rod for removably attaching the lid to the bowl. The rod can have an end portion sized to be received in the blind hole.

In another embodiment, a vibratory tumbler includes a base, a support member movably coupled to the base, a bowl removably attached to the support member, and means for moving the support member and the bowl relative to the base. The bowl includes a base portion and a wall portion projecting a first distance from the base portion. The base portion includes an interior surface and a projection projecting a second distance from the interior surface. The first distance is at least twice the second distance. The wall portion includes a first end section proximate to the base portion and a second end section opposite the first end section. The bowl has a first inner dimension at the first end section and a second inner dimension at the second end section. The first inner dimension is less than the second inner dimension.

In another embodiment, a vibratory tumbler includes a base, a support member movably coupled to the base, a bowl, a connecting assembly for releasably coupling the bowl to the support member, and a motor attached to the support member. The bowl defines an axis and includes a base portion and a wall portion projecting from the base portion. The connecting assembly is configured such that at least a part of the assembly is spaced apart from the axis. The motor is configured to move the support member and the bowl relative to the base for processing workpieces within the bowl.

In another embodiment, a vibratory tumbler includes a base, a support member movably coupled to the base, a bowl removably attached to the support member, and a motor attached to the support member for moving the support member and the bowl relative to the base. The bowl includes a base portion and a wall portion projecting from the base portion. The wall portion includes a proximal section proximate to the base portion and a distal section opposite the proximal section. The bowl further includes a spout at the distal section of the wall portion.

Another aspect of the invention is directed to methods for packaging vibratory tumblers. In one embodiment, a method includes providing a vibratory tumbler having a base, a support member movably coupled to the base, a bowl configured for removable attachment to the support member, and a motor attached to the support member. The method further includes positioning the support member and at least one-half of the base within the bowl.

Specific details of several embodiments of the invention are described below with reference to vibratory tumblers for processing workpieces. For example, the vibratory tumblers can deburr, hone, grind, sand, tumble, polish, clean, and/or otherwise process workpieces. The workpieces can be composed of metal, wood, plastic, ceramic, and/or other materials. Several details describing well-known structures or processes often associated with vibratory tumblers are not set forth in the following description for purposes of brevity and clarity. Also, several other embodiments of the invention can have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 2-10. Where the context permits, singular or plural terms may also include the plural or singular term, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or other types of features and components are not precluded.

B. Embodiments of Vibratory Tumblers

Figure 2:
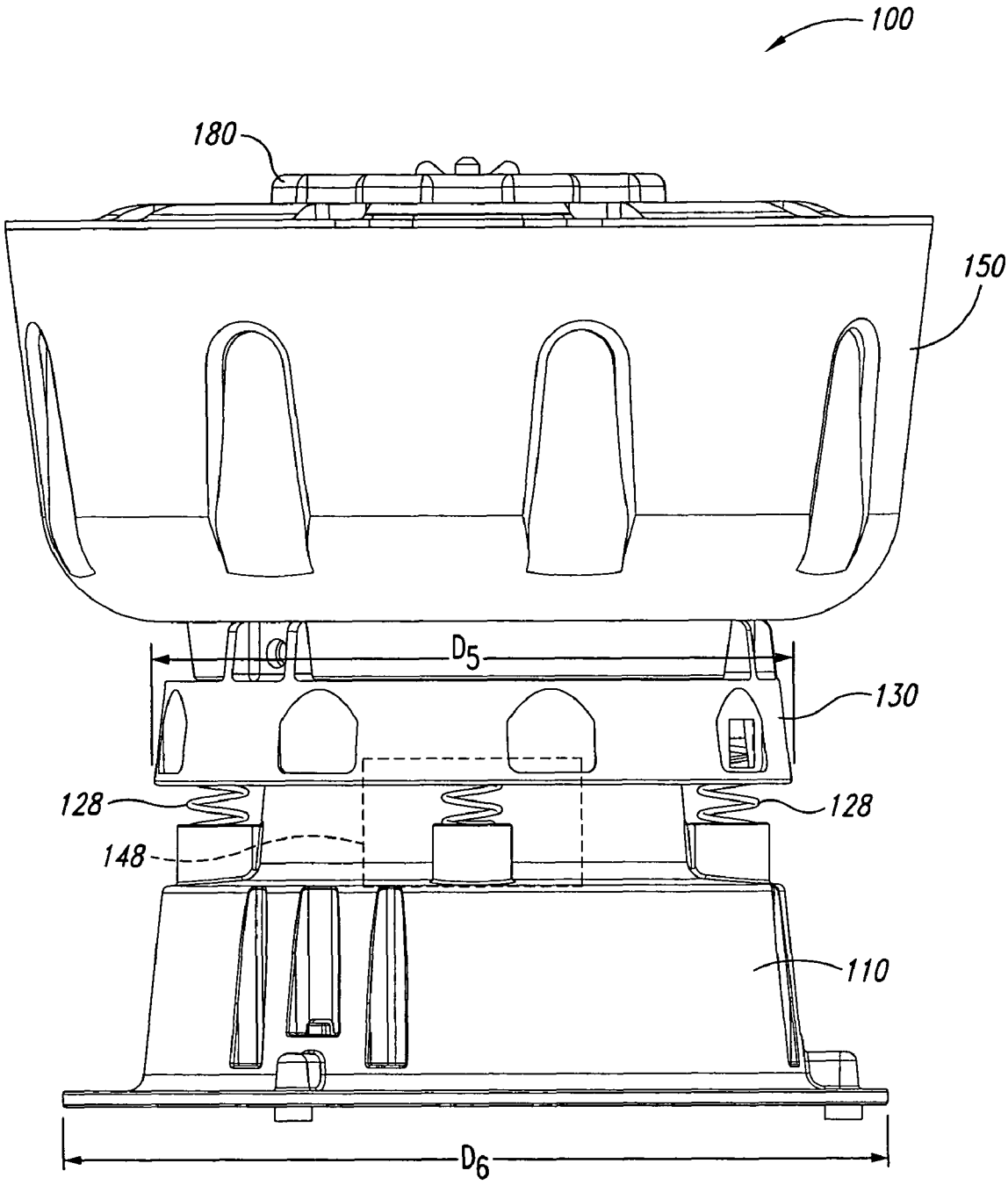
FIG. 2 is a side elevational view of a vibratory tumbler for processing workpieces in accordance with one embodiment of the invention.

FIG. 2 is a side elevational view of a vibratory tumbler 100 for processing workpieces in accordance with one embodiment of the invention. The vibratory tumbler 100 includes a base 110, a support member 130 movably coupled to the base 110, a motor 148 (shown schematically in broken lines) attached to the support member 130 for moving the support member 130, and a bowl 150 removably attached to the support member 130 for carrying workpieces and processing media. In the illustrated embodiment, the base 110 and the support member 130 are coupled together with a plurality of springs 128 that enable the support member 130 to move relative to the base 110. As a result, the motor 148 can vibrate or otherwise move the support member 130 and the bowl 150 to process the workpieces within the bowl 150.

Figure 3:
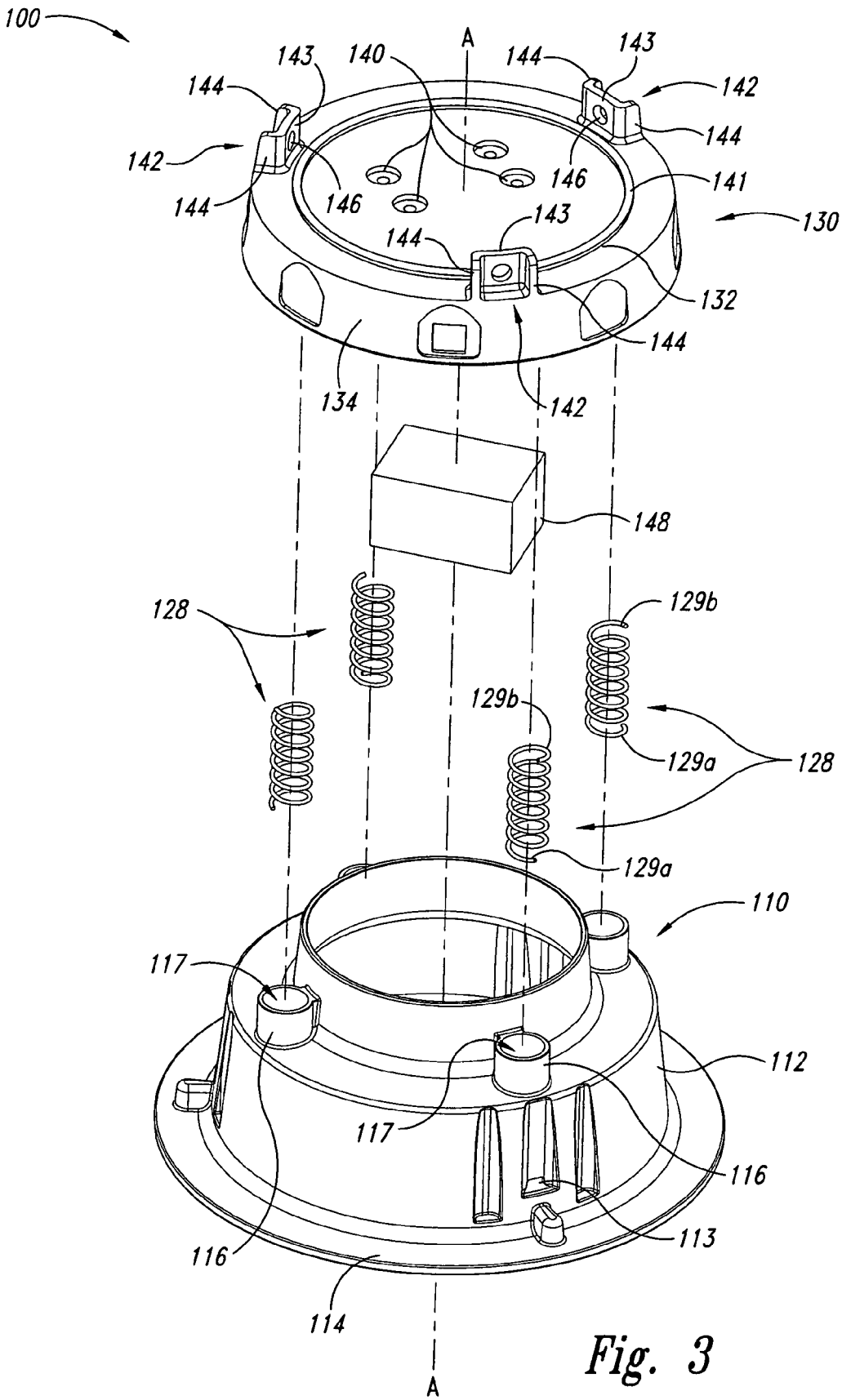
FIG. 3 is an exploded front isometric view of the base, the springs, the support member, and the motor of the tumbler in FIG. 2.

FIG. 3 is an exploded front isometric view of the base 110, the springs 128, the support member 130, and the motor 148 (shown schematically). The individual springs 128 can include a first end 129*a* and a second end 129*b* opposite the first end 129*b* such that the springs 128 extend longitudinally in a direction generally parallel to an axis A-A of the tumbler 100. The illustrated base 110 includes an annular member 112 and a plurality of tubular portions 116 projecting from the annular member 112. The annular member 112 defines a cavity 115 for receiving and enclosing the motor 148 when the support member 130 is attached to the base 110. The illustrated annular member 112 has a plurality of apertures 113 spaced apart circumferentially and a flange 114 projecting radially outward. The individual tubular portions 116 project from the annular member 112 in a direction generally parallel to the axis A-A and include an opening 117 sized to receive the first end 129*a* of a corresponding spring 128.

Figure 4:
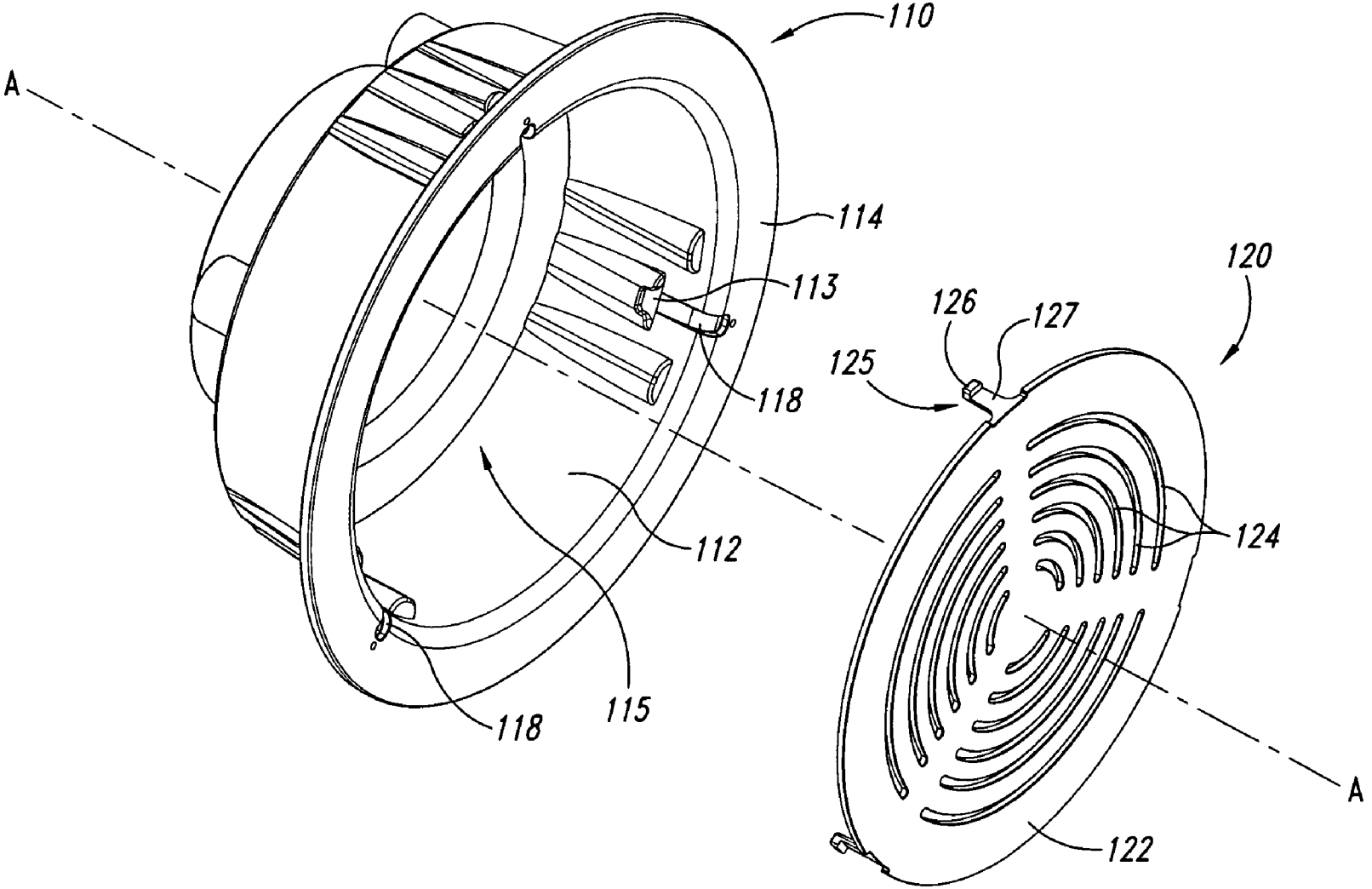
FIG. 4 is an exploded rear isometric view of the base illustrated in FIG. 3.

FIG. 4 is an exploded rear isometric view of the base 110 illustrated in FIG. 3. The illustrated base 110 further includes a base plate 120 attached to the annular member 112 at the flange 114. The base plate 120 has a support member 122 and a plurality of connectors 125 projecting from the support member 122. The support member 122 includes a plurality of arcuate openings 124 so that ambient air can flow into the cavity 115 and cool the motor 148 (FIG. 3) during operation. The support member 122 is configured to contact a table, bench, floor, or other support surface and may further include a plurality of skid-reducing feet (not shown) to inhibit movement of the base 110 relative to the surface during operation. The individual connectors 125 include a head 126 and a neck 127 extending between the head 126 and the support member 122. The head 126 is sized to be received within a corresponding aperture 113 in the annular member 112 to attach the base plate 120 to the annular member 112. In the illustrated embodiment, the neck 127 is flexible and the annular member 112 includes a plurality of grooves 118 extending between the apertures 113 and the flange 114 to facilitate assembly. Specifically, the base plate 120 can be attached to the annular member 112 by placing the heads 126 in corresponding grooves 118 and pressing the base plate 120 toward the annular member 112 to move the heads 126 through the grooves 118 and into corresponding apertures 113. In other embodiments, the base plate 120 can have a different configuration. For example, the base plate 120 and the annular member 112 can form an integral structure in several applications.

Figure 5:
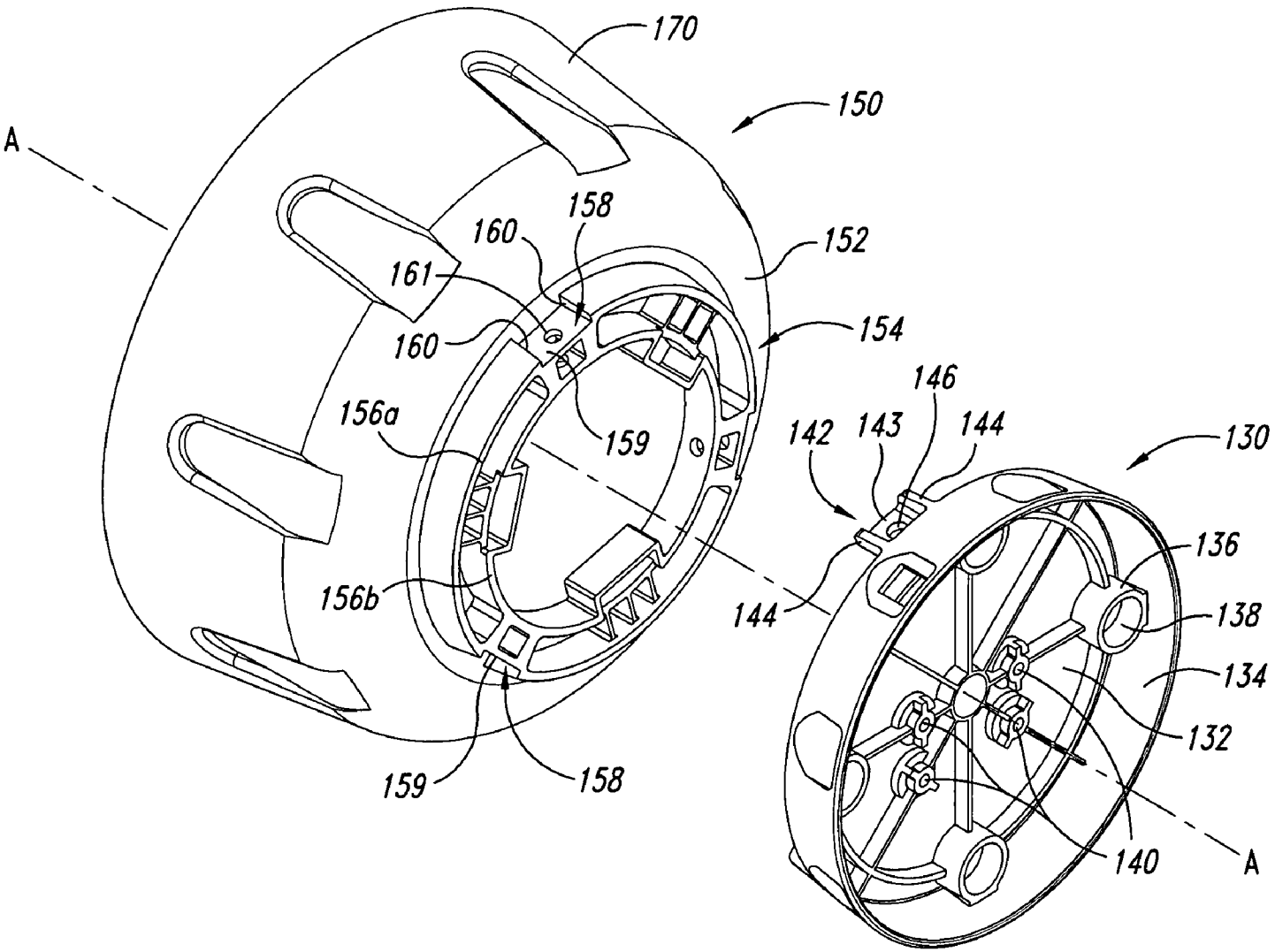
FIG. 5 is an exploded rear isometric view of the support member and the bowl in FIG. 2.

FIG. 5 is an exploded rear isometric view of the support member 130 and the bowl 150. The illustrated support member 130 includes a plate 132, a collar 134 projecting from the plate 132, a plurality of tubular portions 136 projecting from the plate 132 and positioned radially inward of the collar 134, and a plurality of apertures 140 in the plate 132. Referring to both FIGS. 3 and 5, the individual tubular portions 136 (FIG. 5) include an opening 138 (FIG. 5) sized to receive the second end 129*b* (FIG. 3) of a corresponding spring 128 (FIG. 3) so that each spring 128 extends between the support member 130 and the base 110 (FIG. 3). The springs 128 accordingly support the support member 130 over the base 110 and enable the support member 130 to move relative to the base 110. The apertures 140 in the plate 132 are sized to receive corresponding fasteners for fixedly attaching the motor 148 to the support member 130. The motor 148 can be a vibratory motor configured to vibrate or otherwise move the support member 130 relative to the base 110. In other embodiments, the support member 130 can be movably coupled to the base 110 with springs having a different configuration or with another mechanism in lieu of the springs 128.

The illustrated support member 130 further includes a gasket 141 attached to the plate 132 and a plurality of connectors 142 projecting from the plate 132. The gasket 141 is positioned radially inward of the connectors 142 to contact the bottom of the bowl 150. Although the illustrated gasket 141 is a single annular member, in other embodiments the support member 130 may include multiple gaskets with different configurations. The connectors 142 are configured to selectively connect the support member 130 to the bowl 150 (FIG. 5). The connectors 142 are spaced apart circumferentially and project from a perimeter section of the plate 132 in a direction generally parallel to the axis A-A. The illustrated individual connectors 142 include an inner wall 143, two side walls 144 on opposite sides of the inner wall 143, and an aperture 146 in the inner wall 143.

Referring only to FIG. 5, the bowl 150 includes a base portion 152 and a wall portion 170 projecting from the base portion 152. The illustrated base portion 152 includes a collar 154 having an outer wall 156*a* and an inner wall 156*b* radially inward of the outer wall 156*a*. The outer wall 156*a* includes a plurality of recesses 158 generally aligned with corresponding connectors 142 on the support member 130. The individual recesses 158 are defined by a recessed surface 159 and two side surfaces 160. The recesses 158 are sized to receive portions of the corresponding connectors 142 such that when a particular connector 142 is received in a recess 158, the inner wall 143 is juxtaposed with the recessed surface 159 and a portion of each side wall 144 is juxtaposed with the corresponding side surface 160. The connectors 142 and the recesses 158 are accordingly mating components that interact to align the bowl 150 with the support member 130 and inhibit the bowl 150 from pivoting about the axis A-A.

The illustrated collar 154 further includes a plurality of apertures 161 in the recessed surfaces 159. The apertures 161 are aligned with corresponding apertures 146 in the connectors 142 and sized to receive fasteners (not shown) for removably coupling the bowl 150 to the support member 130. Suitable fasteners include detent pins, bolts, and/or other suitable members. In either case, the connectors 142, the recesses 158, and the fasteners form a connecting assembly for connecting the bowl 150 to the support member 130 so that (a) the bowl 150 vibrates or otherwise moves with the support member 130 during operation, and (b) a user can selectively detach the bowl 150 from the support member 130. In other embodiments, the tumbler 100 may include a connecting assembly having a different configuration for coupling the bowl 150 to the support member 130. For example, the support member 130 may include a plurality of bolts that project upward and are received in corresponding holes in the bowl 150. In additional embodiments, the tumbler 100 may not include the support member 130, but rather the bowl 150 can be coupled directly to the base 110. In one such embodiment, the motor 148 can be attached directly to the bowl 150. In another such embodiment, the motor 148 can be attached to the base 110 and operably coupled to the bowl 150. For example, the motor 148 can drive a shaft having a first end at the bowl 150 and a second end with an eccentric weight.

Figure 6:
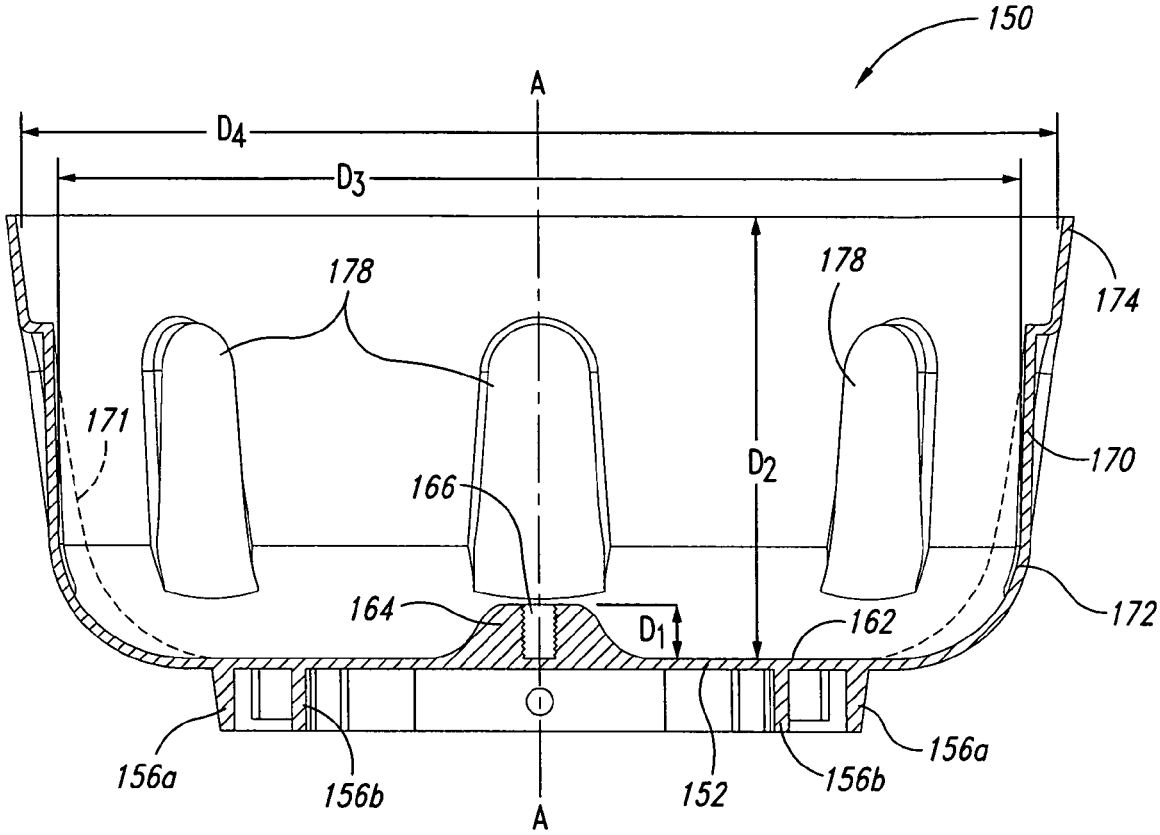
FIG. 6 is a schematic side cross-sectional view of the bowl in FIG. 5.

FIG. 6 is a schematic side cross-sectional view of the bowl 150 in FIG. 5. The base portion 152 of the illustrated bowl 150 includes a generally flat interior surface section 162 and a projection 164 projecting from the interior surface section 162. The projection 164 is aligned with the axis A-A and positioned at a central section of the base portion 152. The projection 164 projects a first distance $D_1$ that is less than one-half (e.g., less than one-third or less than one-fourth) of a depth $D_2$ of the bowl 150. In the illustrated embodiment, the projection 164 includes a threaded blind hole 166 aligned with the axis A-A and extending through only part of the base portion 152. The threads of the blind hole 166 may be integrally formed in the bowl 150, or a threaded insert can be placed in a hole in the projection 164 such that the threaded insert at least partially defines the threaded blind hole 166. In other embodiments, the bowl 150 may not include the projection 164, the hole 166 may be a through hole, and/or the base 152 may not have a generally flat interior surface section 162.

The wall portion 170 includes a proximal end section 172 at the base portion 152 and a distal end section 174 opposite the proximal end section 172. The illustrated wall portion 170 slopes radially outwardly as the portion 170 extends from the proximal end section 172 to the distal end section 174. As a result, the bowl 150 includes a minor inner diameter $D_3$ at the proximal end section 172 and a major inner diameter $D_4$ at the distal end section 174. In other embodiments, the wall portion 170 can have a different slope and/or curvature, such as an interior surface contour 171 illustrated with broken lines in FIG. 6. In additional embodiments, the entire wall portion 170 may not slope radially outwardly between the proximal and distal end sections 172 and 174. For example, only a section of the wall portion 170 may slope radially outwardly, and/or the wall portion 170 may be configured such that the bowl 150 has the same inner diameter at the proximal and distal end sections 172 and 174. In the illustrated embodiment, the wall portion 170 further includes a plurality of ribs 178 spaced apart circumferentially. The ribs 178 project radially inward and strengthen the bowl 150. In other embodiments, such as the embodiments described below with reference to FIGS. 9 and 10, the bowl may not include ribs.

Figure 7:
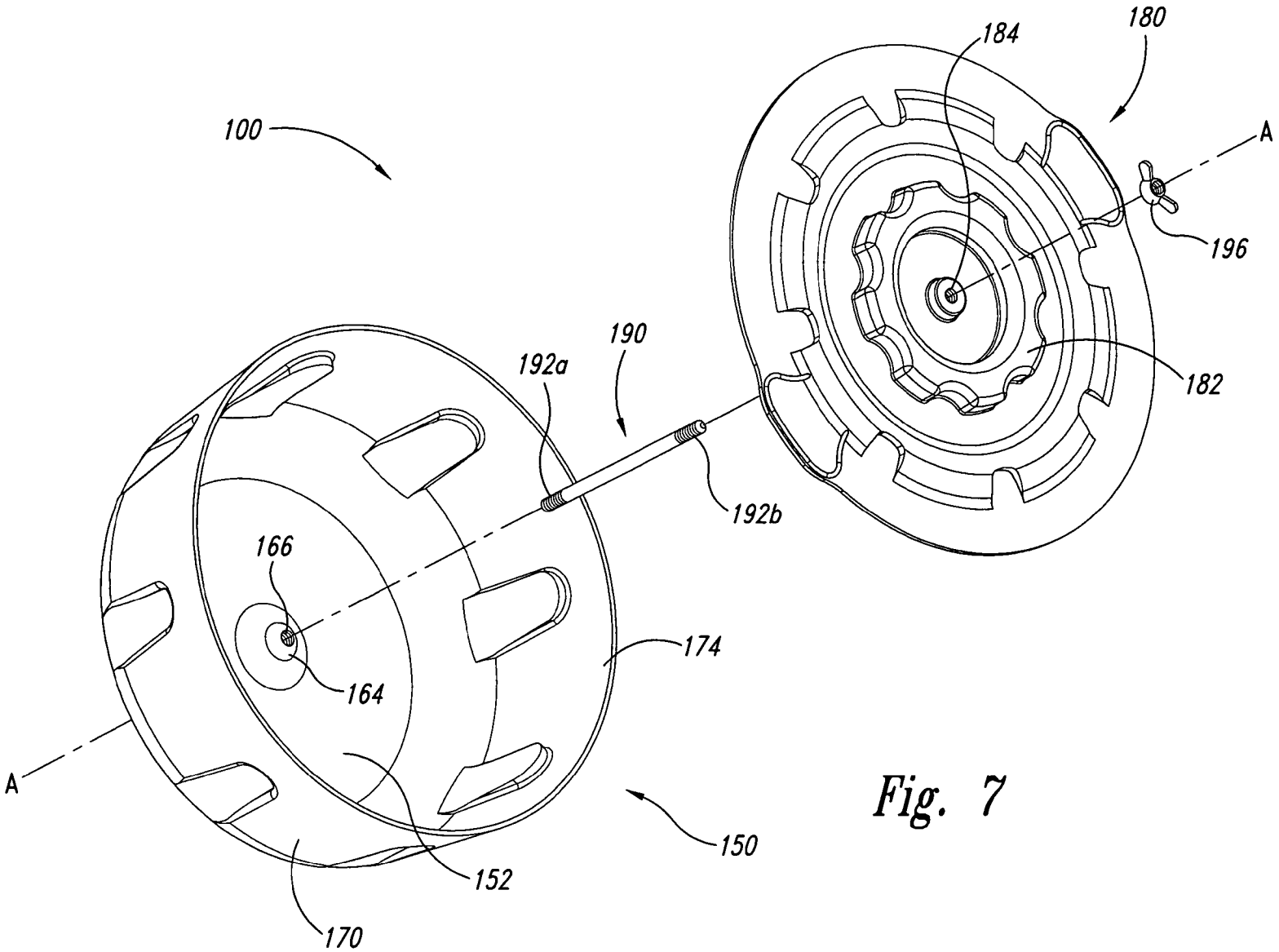
FIG. 7 is an exploded front isometric view of an upper portion of the tumbler in FIG. 2.

FIG. 7 is an exploded front isometric view of an upper portion of the tumbler 100 including the bowl 150, a lid 180 for covering the bowl 150, and a rod 190 for attaching the lid 180 to the bowl 150. The illustrated lid 180 includes a gripping portion 182 and an aperture 184 aligned with the axis A-A. The gripping portion 182 is configured to enable an individual to easily grasp and remove the lid 180 from the bowl 150. The aperture 184 is a through hole sized to receive the rod 190. The illustrated rod 190 includes a first threaded end 192*a* and a second threaded end 192*b*. The first threaded end 192*a* is sized to screw into the threaded blind hole 166 in the bowl 150, and the second threaded end 192*b* is sized to receive a fastener 196 (e.g., wing nut). As a result, when the lid 180 is placed on the bowl 150, the rod 190 extends through the aperture 184 in the lid 180 and the fastener 196 secures the lid 180 to the bowl 150. In other embodiments, the tumbler 100 may include a different mechanism for coupling the lid 180 to the bowl 150. For example, the tumbler 100 may include a clamping device that engages the rod 190 to secure the lid 180 to the rod 190. The clamping device can be a quick connect and disconnect mechanism that is spring loaded and detached from the rod 190 by squeezing.

Figure 8:
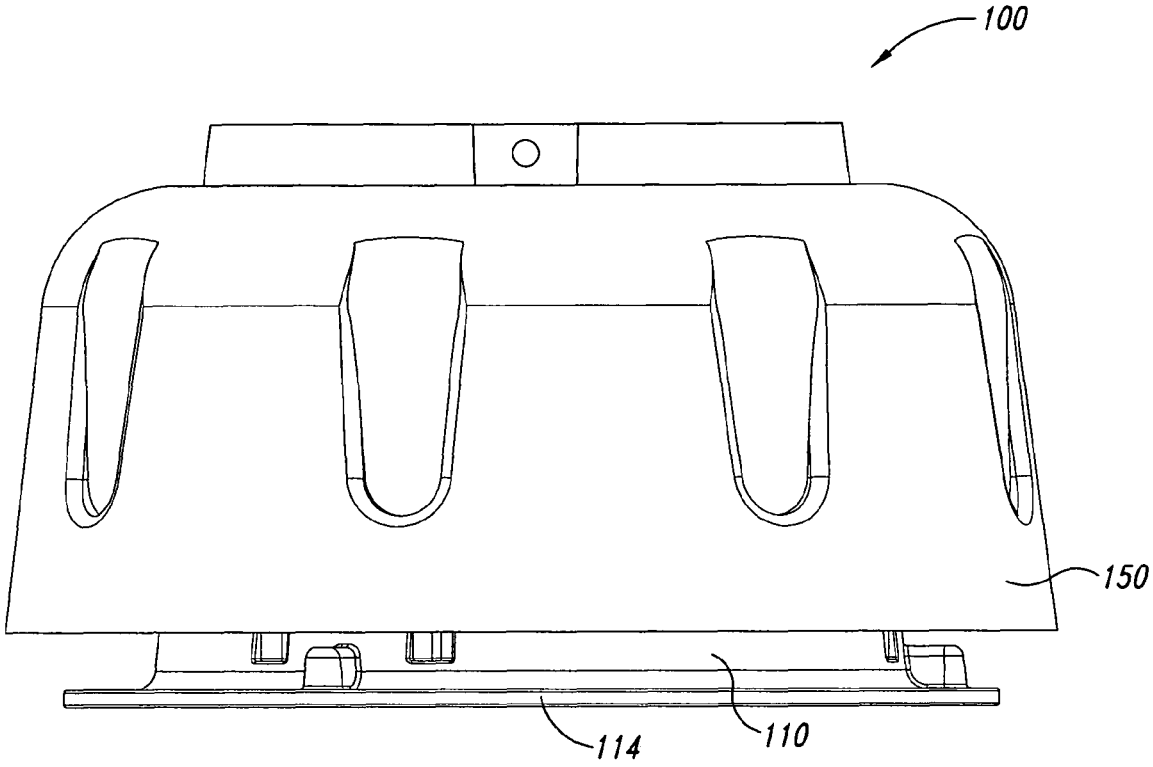
FIG. 8 is a front elevational view of the vibratory tumbler in FIG. 2 with the support member and a portion of the base received within the bowl.

FIG. 8 is a front elevational view of the vibratory tumbler 100 with the support member 130 and a portion of the base 110 received within the bowl 150. Referring to FIGS. 2, 6 and 8, in the illustrated embodiment, the bowl 150 is sized and configured to receive the support member 130 and a portion of the base 110 because (a) the projection 164 (FIG. 6) projects only a relatively short distance $D_1$ (FIG. 6) from the base portion 152 (FIG. 6), (b) the minor inner diameter $D_3$ (FIG. 6) of the bowl 150 is greater than a major diameter $D_5$ (FIG. 2) of the support member 130, and (c) the major inner diameter $D_4$ (FIG. 6) of the bowl 150 is greater than a major diameter $D_6$ (FIG. 2) of the base 110. As a result, the illustrated vibratory tumbler 100 is sized such that the support member 130 and approximately three-quarters of the base 110 can be received within the bowl 150. In additional embodiments, however, the portion of the base 110 that nests within the bowl 150 can be different. For example, in several embodiments, the support member 130 and one-fourth of the base 110 can be received within the bowl 150. In other embodiments, the support member 130 and the one-half of the base 110 can be received within the bowl 150. In additional embodiments, the support member 130 and the entire base 110 can be received within the bowl 150. In other embodiments, the tumbler 100 may be sized such that the base 110 and/or the support member 130 cannot be received within the bowl 150.

One feature of the vibratory tumbler 100 illustrated in FIGS. 2-8 is that the base 110, the support member 130, and the bowl 150 are sized and configured such that the support member 130 and a portion of the base 110 can nest within the bowl 150. As a result, the bowl 150 can be detached from the support member 130 and placed over the support member 130 and a portion of the base 110 to reduce the vertical profile or height of the tumbler 100 for storage, transport, and/or shipping. An advantage of this feature is that the smaller vertical profile of the illustrated tumbler 100 reduces the space required to store the tumbler 110 and reduces the costs of shipping the tumbler 100 from the manufacturer to the consumer or retailer.

Another feature of the vibratory tumbler 100 illustrated in FIGS. 2-8 is that the wall portion 170 extends radially outward as the portion 170 projects away from the base portion 152 such that a portion of the bowl 150 can be placed within another bowl 150 in a stacked arrangement. As a result, a bowl manufacturer can reduce the volume of a batch of bowls 150 by stacking the bowls 150 within one another. An advantage of this feature is that the reduced volume of the batch of stacked bowls minimizes the costs of shipping the bowls.

Another feature of the vibratory tumbler 100 illustrated in FIGS. 2-8 is that the projection 164 in the bowl 150 includes a blind hole 166. An advantage of this feature is that liquid processing media or processing media having a liquid component can be placed in the bowl 150 and used to process workpieces in the illustrated vibratory tumbler 100 without the risk of the liquid media leaking from the bowl 150.

C. Additional Embodiments of Vibratory Tumblers

Figure 9:
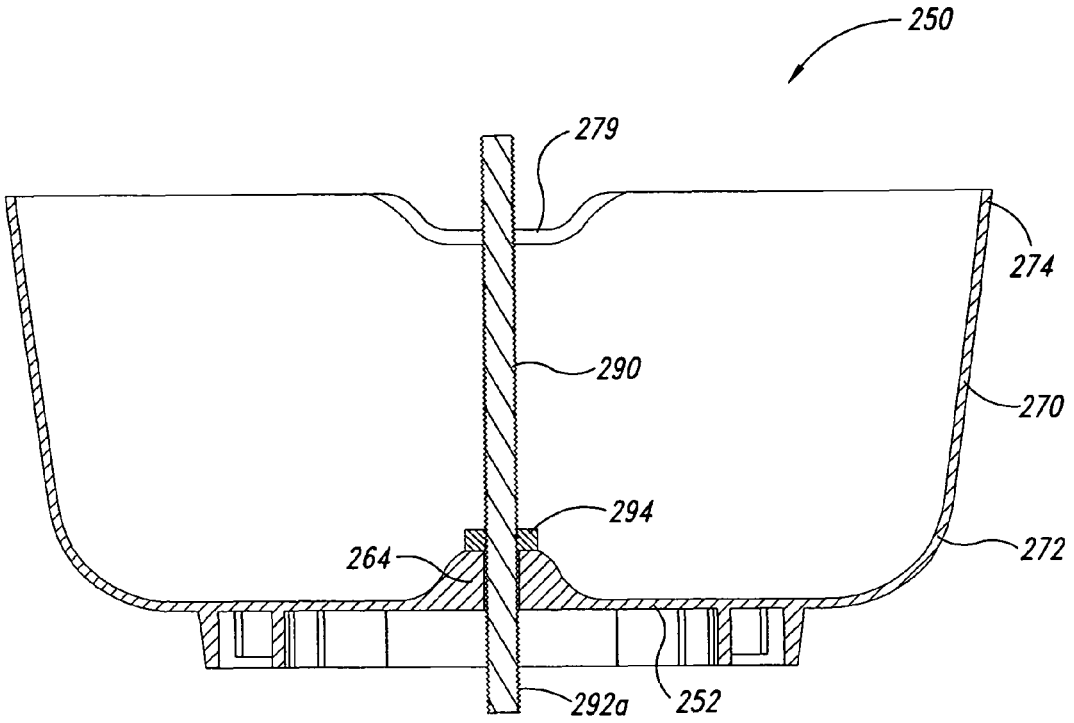
FIG. 9 is a schematic side cross-sectional view of a bowl and a threaded rod in accordance with another embodiment of the invention.

FIG. 9 is a schematic side cross-sectional view of a bowl 250 and a threaded rod 290 in accordance with another embodiment of the invention. The bowl 250 is generally similar to the bowl 150 described above with reference to FIGS. 2-8. For example, the illustrated bowl 250 includes a base portion 252 and a wall portion 270 projecting from the base portion 252. The illustrated base portion 252, however, includes a projection 264 having a through hole 266 extending through the base portion 252. The threaded rod 290 is sized to fit within the hole 266 and includes a first threaded end 292*a* configured to screw into a threaded hole in a support member. A fastener 294 can be placed on the rod 290 and positioned against the projection 264 to couple the bowl 250 to the support member. Another fastener (not shown) can be placed on the rod 290 and positioned against an exterior surface of the lid to connect the lid to the bowl 250. In other embodiments, the bowl 250 may not include a through hole 266, and/or the support member, the bowl 250, and the lid can be connected with other devices.

The illustrated bowl 250 further includes a spout 279 at a distal end section 274 of the wall portion 270. The spout 279 is sized and configured to enable a user to easily pour the abrasive or polishing media, the workpieces, and the other contents from the bowl 250 without spilling the material. The illustrated bowl 250 also does not include a plurality of ribs in the wall portion 270. In other embodiments, the wall portion 270 may not include the spout 279, and/or may include a plurality of ribs.

Figure 10:
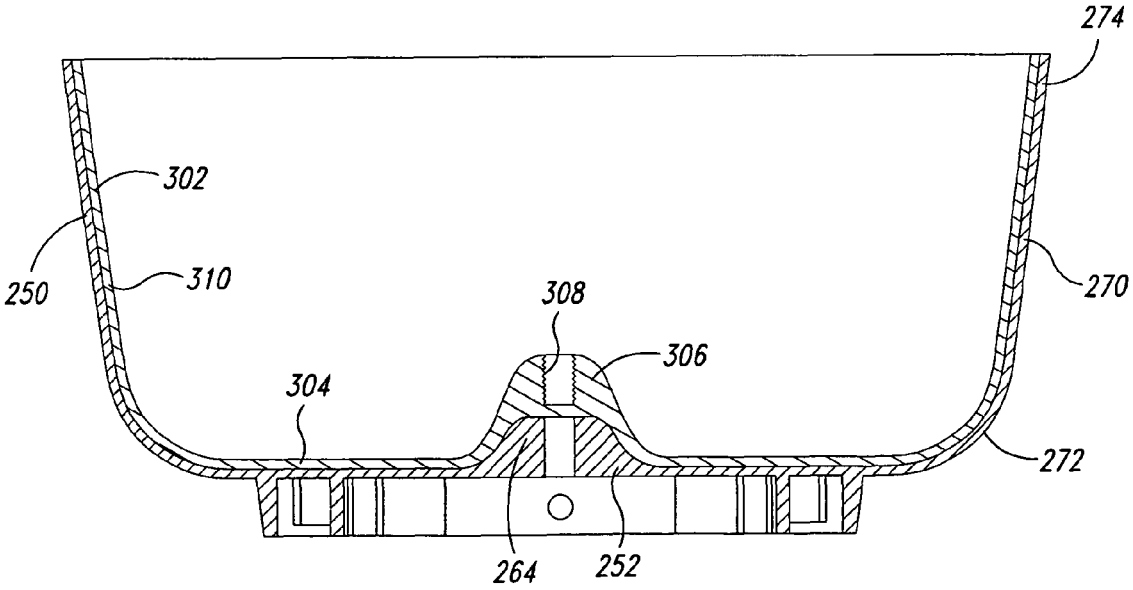
FIG. 10 is a schematic side cross-sectional view of the bowl in FIG. 9 with a liner placed in the bowl in accordance with another embodiment of the invention.

FIG. 10 is a schematic side cross-sectional view of the bowl 250 in FIG. 9 with a liner 302 placed in the bowl 250 in accordance with another embodiment of the invention. The liner 302 is configured to cover at least a lower portion of the interior surface of the bowl 250 to protect the bowl 250 from exposure to caustic polishing or abrasive media or other chemicals that would otherwise damage the bowl 250. The liner 302 can be composed of a metallic material or other material that is inert or otherwise not significantly adversely affected by the contents placed in the bowl 250 during operation. The illustrated liner 302 includes a base portion 304 and a wall portion 310 projecting from the base portion 304. The base portion 304 is sized to be positioned proximate to the base portion 252 of the bowl 250, and the wall portion 310 is sized and configured to be placed adjacent to the wall portion 270 of the bowl 250. The illustrated base portion 304 includes a projection 306 with a threaded blind hole 308 for receiving an end of the rod 190 (FIG. 7). In other embodiments, the wall portion 310 of the liner 302 may not cover the entire interior surface of the bowl 250.

From the foregoing, it will be appreciated that specific embodiments of the invention have been described herein for purposes of illustration, but that various modifications may be made without deviating from the spirit and scope of the invention. For example, many of the elements of one embodiment can be combined with other embodiments in addition to or in lieu of the elements of the other embodiments. Accordingly, the invention is not limited except as by the appended claims.

I/We claim:

1. A vibratory tumbler for processing workpieces, the tumbler comprising:

a base having an upper section, the upper section having a diameter;

a support member having a diameter, the support member movably coupled to the base;

a bowl configured for removable attachment to the support member, the bowl being sized and configured such that the support member and at least one-fourth of the upper section of the base can be received within the bowl while the support member is coupled to the base, the bowl includes a base portion and a wall portion projecting from the base portion, the wall portion including a first end section proximate to the base portion and a second end section opposite the first end section wherein the bowl has a minor inner diameter at the first end section and a major inner diameter at the second end section greater than the diameter of the base and the support member; and a motor attached to at least one of the support member, the base, or the bowl for moving the bowl relative to the base.

2. The vibratory tumbler of claim 1 wherein:

the base portion comprises an interior surface and a projection projecting a first distance from the interior surface;

the wall portion projects a second distance from the interior surface of the base portion;

the second distance is at least twice the first distance;

the projection includes a blind hole; and the motor is at least partially enclosed by the base.

3. The vibratory tumbler of claim 1 wherein the wall portion including a first end section proximate to the base portion and a second end section opposite the first end section, and wherein the bowl has a first inner dimension at the first end section and a second inner dimension at the second end section, the first inner dimension being less than the second inner dimension.

4. The vibratory tumbler of claim 1 wherein the wall portion including a first end section proximate to the base portion and a second end section opposite the first end section, and wherein the bowl has a minor inner diameter at the first end section and a major inner diameter at the second end section.

5. The vibratory tumbler of claim 1 wherein the base portion including an interior surface and a projection projecting from the interior surface, the projection including a blind hole.

6. The vibratory tumbler of claim 1 wherein the wall portion including a first end section proximate to the base portion and a second end section opposite the first end section, and wherein the bowl further comprises a spout at the second end section of the wall portion.

7. The vibratory tumbler of claim 1 wherein the bowl comprises a plurality of spaced-apart ribs projecting radially inwardly and/or outwardly.

8. The vibratory tumbler of claim 1 wherein the base portion including an interior surface with a flat section.

9. The vibratory tumbler of claim 1 wherein:

the wall portion including a first end section proximate to the base portion and a second end section opposite the first end section;

the base portion comprises an interior surface and a projection projecting a first distance from the interior surface;

the wall portion projects a second distance from the interior surface of the base portion; and the second distance is at least twice the first distance.

10. The vibratory tumbler of claim 1 wherein:

the bowl defines an axis; and the tumbler further comprises a connecting assembly for releasably coupling the bowl to the support member, at least a portion of the connecting assembly being spaced apart from the axis.

11. The vibratory tumbler of claim 1 wherein:

the bowl comprises an interior surface; and the tumbler further comprises a liner configured to be positioned within the bowl and cover at least a portion of the interior surface of the bowl.

12. The vibratory tumbler of claim 1 wherein:

the bowl defines an axis and includes a base portion and a wall portion projecting from the base portion; and the wall portion projects generally radially outward relative to the axis as the wall portion projects away from the base portion.

13. The vibratory tumbler of claim 1 wherein the motor is at least partially enclosed by the base.

14. A vibratory tumbler for processing workpieces, the tumbler comprising:

a base, the base having a diameter;

a bowl removably coupled to the base, the bowl including a base portion and a wall portion projecting from the base portion in a first direction, wherein the bowl has a minor inner diameter at a first end section and a major inner diameter at a second end section greater than the diameter of the base, the base portion including a projection projecting generally in the first direction, the projection having a blind hole; and a motor operably coupled to the bowl for moving the bowl relative to the base.

15. The vibratory tumbler of claim 14 wherein the blind hole is a threaded blind hole.

16. The vibratory tumbler of claim 14, further comprising:

a support member movably coupled to the base and removably coupled to the bowl;

a lid for covering the bowl; and a rod for removably attaching the lid to the bowl, the rod having an end portion sized to be at least partially received in the blind hole.

17. The vibratory tumbler of claim 14 wherein the base portion further comprises a central section, and wherein the projection is positioned at the central section of the base.

18. The vibratory tumbler of claim 14 wherein:

the wall portion has a proximal end section at the base portion and a distal end section opposite the proximal end section; and the bowl has a minor inner dimension at the proximal end section and a major inner dimension at the distal end section.

19. The vibratory tumbler of claim 14 wherein:

the tumbler further comprises a support member movably coupled to the base and removably coupled to the bowl; and the bowl is sized and configured such that the support member and at least one-half of the base can be received within the bowl.

20. The vibratory tumbler of claim 14 wherein:

the wall portion has a proximal section at the base portion and a distal section opposite the proximal section; and the bowl further comprises a spout at the distal section of the wall portion.

21. The vibratory tumbler of claim 14 wherein:

the base portion further comprises an interior surface;

the projection projects a first distance from the interior surface;

the wall portion projects a second distance from the interior surface of the base portion; and the second distance is at least twice the first distance.

22. A vibratory tumbler for processing workpieces, the tumbler comprising:

a base having a dimension;

a support member movably coupled to the base having a dimension;

a bowl removably attached to the support member, the bowl including a base portion and a wall portion projecting a first distance from the base portion, the base portion including an interior surface and a projection projecting a second distance from the interior surface, the first distance being at least twice the second distance, the wall portion including a first end section proximate to the base portion and a second end section opposite the first end section, wherein the bowl has a first inner dimension at the first end section and a second inner dimension at the second end section, and wherein the second inner dimension is greater than the first inner dimension, the base dimension and the support member dimension; and means for moving the bowl relative to the base.

23. The vibratory tumbler of claim 22 wherein the interior surface of the base portion comprises a central section, and wherein the projection is positioned at the central section.

24. The vibratory tumbler of claim 22 wherein the first distance is at least three times the second distance.

25. The vibratory tumbler of claim 22 wherein the means for moving the support member comprise a motor for moving the bowl to process the workpieces in the bowl.

26. The vibratory tumbler of claim 22 wherein the projection comprises a blind hole.

27. A vibratory tumbler for processing workpieces, the tumbler comprising:

a base having a diameter;

a support member movably coupled to the base, the support member having a diameter;

a bowl including a base portion and a wall portion projecting from the base portion, wherein the bowl has a minor inner diameter at a fist end section and a major inner diameter at a second end section greater than the diameter of a portion of the base and the support member, the bowl defining an axis;

a connecting assembly for releasably coupling the bowl to the support member, at least a portion of the connecting assembly being spaced apart from the axis; and a motor attached to the support member for moving the support member and the bowl relative to the base to process workpieces within the bowl.

28. The vibratory tumbler of claim 27 wherein the wall portion projects from the base portion in a first direction, and wherein the connecting assembly comprises:

a collar on the bowl and projecting from the base portion in a second direction generally opposite the first direction; and a plurality of connecting members projecting from the support member and positioned to interface with the collar.

29. The vibratory tumbler of claim 27 wherein the connecting assembly comprises:

a first mating structure on the bowl; and a second mating structure on the support member, the second mating structure being positioned to interface with the first mating structure.

30. The vibratory tumbler of claim 27 wherein the axis comprises a first axis, and wherein the connecting assembly comprises:

a first hole in the bowl;

a second hole in the support member, wherein the first and second holes are aligned when the bowl is attached to the support member and define a second axis generally transverse to the first axis; and a fastener received in the first and second holes for connecting the bowl to the support member.

31. A vibratory tumbler for processing workpieces, the tumbler comprising:

a base having an upper portion, the upper portion having a diameter;

a support member movably coupled to the base, the support member having a diameter;

a bowl removably attached to the support member, the bowl including a base portion and a wall portion projecting from the base portion, the wall portion including a proximal section proximate to the base portion and a distal section opposite the proximal section, wherein the bowl has a minor inner support member, the bowl further including a spout at the distal section of the wall portion; and a motor attached to at least one of the support member, the base, or the bowl for moving the bowl relative to the base.

32. The vibratory tumbler of claim 31 wherein the base portion comprises an interior surface and a projection projecting from the interior surface, the projection including a blind hole.

33. The vibratory tumbler of claim 31 wherein:

the base portion comprises an interior surface and a projection projecting a first distance from the interior surface;

the wall portion projects a second distance from the base portion; and the second distance is at least twice the first distance.

34. The vibratory tumbler of claim 31 wherein the bowl has a minor inner dimension at the proximal section and a major inner dimension at the distal section.

35. The vibratory tumbler of claim 31 wherein the bowl is sized and configured such that the support member and at least one-half of the base can be received within the bowl.

* * * * *

UNITED STATES PATENT AND TRADEMARK OFFICE

CERTIFICATE OF CORRECTION

PATENT NO. : 7,883,396 B2
APPLICATION NO. : 11/507683
DATED : February 8, 2011
INVENTOR(S) : Russell A. Potterfield et al.

It is certified that error appears in the above-identified patent and that said Letters Patent is hereby corrected as shown below:

In column 12, line 18, in Claim 31, after "inner" insert -- diameter at a first end section and a major inner diameter at a second end section greater than the diameter of the upper portion of the base and/or the --.

Signed and Sealed this
Twenty-eighth Day of June, 2011

David J. Kappos

David J. Kappos
*Director of the United States Patent and Trademark Office*